United States Patent [19]

Becker et al.

[11] 4,298,683

[45] Nov. 3, 1981

[54] LIGHT-SENSITIVE PHOTOGRAPHIC MATERIAL

[75] Inventors: Manfred Becker; Angela Slabik, both of Leverkusen; Bruno Mücke, Bergisch-Gladbach; Erik Moisar, Cologne; Harald von Rintelen, Leverkusen, all of Fed. Rep. of Germany

[73] Assignee: AGFA-Gevaert Aktiengesellschaft, Bayerwerk-Leverkusen, Fed. Rep. of Germany

[21] Appl. No.: 55,481

[22] Filed: Jul. 6, 1979

Related U.S. Application Data

[63] Continuation-in-part of Ser. No. 971,501, Dec. 20, 1978, abandoned.

[30] Foreign Application Priority Data

Dec. 29, 1977 [DE] Fed. Rep. of Germany ..... 2758711

[51] Int. Cl.[3] ..... G03C 1/52

[52] U.S. Cl. ..... 430/569; 430/434; 430/567; 430/600; 430/614

[58] Field of Search ..... 430/569, 600, 614, 567, 430/434

[56] References Cited

U.S. PATENT DOCUMENTS

| | | | |
|---|---|---|---|
| 1,696,830 | 12/1928 | Wulff et al. | 430/569 |
| 3,086,863 | 4/1963 | Hunt et al. | 430/600 |
| 3,482,980 | 12/1969 | Hayakawa et al. | 430/614 |
| 3,661,592 | 5/1972 | Philippaerts et al. | 430/567 |
| 3,704,130 | 11/1972 | Pollet et al. | 430/567 |

*Primary Examiner*—J. Travis Brown
*Attorney, Agent, or Firm*—Connolly and Hutz

[57] ABSTRACT

A photographic material with at least one light-sensitive silver halide emulsion is disclosed. The emulsion has been prepared by carrying out the precipitation of the silver halide in the presence of certain imidazoles.

8 Claims, No Drawings

LIGHT-SENSITIVE PHOTOGRAPHIC MATERIAL

CROSS REFERENCE

This application is a continuation-in-part of the copending U.S. Application Ser. No. 971,501 filed Dec. 20, 1978 by Becker et al, entitled "Light-Sensitive Photographic Material", now abandoned.

This invention relates to a photographic material with at least one light-sensitive silver halide emulsion layer, in which the silver halide grains have been precipitated in the presence of imidazole and/or imidazole derivatives. It also relates to a process for the preparation of such photographic materials and to a process for the production of photographic images.

When preparing photographic materials in an aqueous solution of gelatine and halide ions, it is known to produce small silver halide crystals by the addition of silver ions (single jet) or the simultaneous addition of silver ions and halide ions (double jet) and then to leave these crystals to grow. The small silver halide crystals initially precipitated will hereinafter be referred to as silver halide nuclei.

The necessity to allow only a portion of the silver halide nuclei to grow is due to the fact that the number of silver halide nuclei formed is generally much greater than the number of silver halide crystals which should be produced from the given quantity of starting materials. If all of the silver halide nuclei produced from a given quantity of starting materials were allowed to grow, the silver halide crystals obtained would generally be too small and therefore insufficiently sensitive.

Various methods are known by which the number of silver halide nuclei initially formed by precipitation can subsequently be reduced.

In the earliest known process, the number of nuclei is reduced by heat treating the emulsion in the presence of excess halide ions after the precipitation (Charles Bennet, The British Journal of Photography, 1878, page 146). In this so-called physical ripening or Ostwald ripening, the larger crystals continue to grow at the expense of smaller crystals, and some of the smaller crystals dissolve. A detailed description of this method of ripening is given in P. Glafkides, Chemie et physique photographiques, 3rd Edition, 1967, pages 339–344.

In another known process, the number of silver halide nuclei produced initially is subsequently reduced by precipitating a silver halide emulsion, removing a small portion of the precipitate and dispersing this small portion in a gelatine solution, and then allowing additional silver halide to grow on this small portion by means of double inflow until the crystals have the desired size. This process has been described, for example, in German Offenlegungsschrift No. 2,107,118 and in British Pat. No. 1,170,648.

A well known variation of the last mentioned process consists of separating a small portion from an emulsion precipitate, dispersing it in a gelatine solution, adding a fine grained emulsion (grain diameter $<0.3$ $\mu$m) and stirring the mixture in the presence of excess halide ions at an elevated temperature until the more finely grained emulsion has dissolved and its silver halide has grown on the silver halide crystals provided.

All the processes mentioned above have the disadvantage that a larger quantity of silver halide nuclei per mol of silver is initially formed than is desired and special measures must subsequently be taken to reduce the number of silver halide nuclei to the required amount.

From U.S. Pat. No. 3,574,628 it is known to prepare monodisperse emulsions containing relatively large silver halide grains in the presence of a thioether. One of the main disadvantages of using thioethers in the precipitation of photographic emulsions is that they are difficult to obtain in the pure state and may contain undesirable impurities. The instability of thioethers, especially in the presence of silver ions, is equally disadvantageous. The products resulting from the decomposition of thioethers may cause an undesirably high fog, especially if the emulsions are subsequently chemically ripened.

The problem therefore exists of finding a photographic material which reduces or substantially obviates the disadvantages of known materials. Another problem is to provide an improved process for the preparation of such materials, particularly one in which only the required number of silver halide nuclei are formed from the start so that no subsequent measures are required for reducing the number.

We now have found a photographic material having at least one light-sensitive silver halide emulsion layer of silver halide grains, which grains have been precipitated in the presence of certain imidazoles.

Particularly advantageous imidazoles are those corresponding to the following general formula I

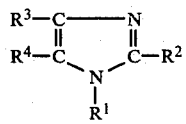

I in which $R^1$, $R^2$, $R^3$ and $R^4$ which may be the same or different, represent hydrogen and/or substituted and unsubstituted alkyl, alkenyl, aryl and/or aralkyl groups.

These substituents may combine with the imidazole nucleus tc form a multiple ligand for silver ions, for example the particularly suitable 1-allyl-imidazole.

Preferred alkyl groups contain from 1 to 8 carbon atoms, particularly from 1 to 4 carbon atoms, e.g. methyl and ethyl. Alkenyl groups may contain from 3 to 8 carbon atoms, e.g. allyl, butenyl, hexenyl or octenyl. Particularly preferred are alkenyl groups containing 3 or 4 carbon atoms, e.g. allyl. Aryl groups may contain from 6 to 12 carbon atoms, e.g. phenyl, biphenyl or naphthyl. Phenyl is particularly preferred. Aralkyl groups may have 1 or 2 carbon atoms in the aliphatic part and 6 to 12 carbon atoms in the aromatic part, e.g. benzyl and phenylethyl.

Suitable substituted alkyl groups include, for example, hydroxyl, cyano and alkoxy groups and free or esterified carboxyl and/or sulphoalkyl groups. The compounds used according to the invention are preferably water-soluble.

Examples of particularly suitable compounds are set out in the following Table 1:

TABLE 1

| Compound No. | Compound |
|---|---|
| 1 | Imidazole |
| 2 | 1-methylimidazole |
| 3 | 2-methylimidazole |
| 4 | 1,2-dimethylimidazole |
| 5 | 1-allylimidazole |
| 6 | 1-methoxymethylimidazole |
| 7 | 1-(2-carboxyethyl)-imidazole |

TABLE 1-continued

| Compound No. | Compound |
|---|---|
| 8 | 4(or 5)-methylimidazole |
| 9 | 2-ethyl-4-methylimidazole |

The following groups, for example, are not suitable as substituents: HS-, thioether-containing groups (e.g. $CH_3$—S—$CH_2$—) and heterocyclic groups such as 2-imidazolyl-(1)-ethyl and 2-imidazolyl-(2)-ethyl.

Examples of methods of preparation of imidazole and its derivatives may be found e.g. in Klaus HOFMANN, "The Chemistry of Heterocyclic Compounds, Imidazole and Its Derivatives", Interscience Publishers, New York-London, 1953, and in the literature cited in this book.

The materials according to the invention are particularly suitable for the production of photographic images by imagewise exposure, development and usual further processing.

The imidazole compounds used according to the invention may be added to the emulsion at any stage of its preparation and either singly or in combination. According to the invention, they are preferably already added to the reaction mixture in which the silver halide is precipitated. They may also be added to (a) The starting solution which contains the silver ions, generally a silver nitrate solution; or (b) the starting solution containing halides.

When precipitating the emulsion, the protective colloid, in particular gelatine, may be present not only in the original reaction mixture but also in the halide solution run into it.

The compounds used according to the invention may be used over a very wide range of concentrations. The concentration to be employed in any particular case depends upon the desired ultimate size of the silver halide crystals and may vary from a $10^{-4}$ molar solution to the point of saturation of the compound. They are preferably used as 0.003 molar to 1 molar solutions. The pH in the precipitation medium is generally above 5, preferably from 5.5 to 6.5, although precipitations may also be carried out in alkaline solution. The pH value in the precipitation medium can also be altered during precipitation. Especially it is possible, to precipitate the silver halide nuclei at pH$>$5 and to let them grow afterwards into larger silver halide crystals at pH $<$5.

Silver halide emulsions precipitated in the presence of imidazoles according to the invention are separated from water soluble salts and other water soluble substances after the precipitation step as known in the art, e.g. by flocculation and/or washing with water. Under such conditions the imidazoles are removed from the emulsion due to their solubility in water. Therefore, they cannot affect and impair the further processing of the photographic material since they are removed after precipitation.

It had already been known in the art to use imidazoles in photographic materials, e.g. as antifogging agents. But in these materials the imidazoles are either added after washing and flocculation or the emulsions are not washed at all.

The photographic emulsions of this invention generally comprise silver halide grains having a substantially uniform diameter. Preferred photographic emulsions of this invention comprise silver halide grains, at least 95%, of said grains having a diameter which is within 40%, preferably within about 30%, of the mean grain diameter. Silver halide grains having a narrow size distribution can be obtained by controlling the conditions at which the silver halide grains are prepared using a double jet procedure. Suitable methods for preparing photographic silver halide emulsions generally having uniform particle size are disclosed in an article entitled "Ia: Properties of Photographic Emulsion Grains", by Klein and Moisar, The Journal of Photographic Science, vol. 12, 1963, pages 242–251.

In a preferred embodiment of this invention the emulsion comprises grains having a cubic or octahedral structure.

The usual silver halide emulsions are suitable for the present invention. The silver halide contained in them may comprise silver chloride, silver bromide and silver iodide. They may be negative emulsions or direct positive emulsions. The emulsion grains may have ripening nuclei both internally and externally or they may have a layered grain structure.

The material according to the invention may be used for the so-called silver dye bleaching process. The present invention is also suitable for the instant image colour process and colour transfer processes. In these processes, the dyes for the partial colour images diffuse into an image receiving layer where they become firmly fixed or the colour couplers diffuse into the image receiving layer where they are converted into the image dye after the usual colour producing development.

The light-sensitive material generally contains three light-sensitive emulsion layers, each of which has a colour producing system associated with it. By "colour producing system" is meant a compound incorporated in a diffusion resistant form in the particular layer which compound is a dye or a dye precursor product which releases diffusible dyes, preferably dyes containing acid groups, under the action of oxidation products which are produced imagewise from the photographic developers when development is carried out in the presence of the alkaline processing mass. A wide variety of chemical compounds are available for use as such colour producing systems. The diffusion resistant colour producing substances according to U.S. Pat. No. 3,628,952, for example, are particularly suitable. These compounds release diffusible dyes in their reaction with oxidation products of black-and-white developers or colour developers. Another suitable class of compounds has been described in German Pat. No. 1,095,115. The compounds mentioned in the said Patent react with oxidized colour developers to produce diffusible dyes which generally belong to the class of azomethine dyes. Another suitable colour producing system has been described in U.S. Pat. Nos. 3,443,939 and 3,443,940. In this system, the release of diffusible dyes is accompanied by ring closure under the action of oxidized developer substances.

Colour transfer processes and couplers used in such processes which may also be used in the present invention have also been described in U.S. Pat. Nos. 2,983,606; 3,087,817; 3,185,567; 3,227,550; 3,227,551; 3,227,552; 3,227,554; 3,253,915; 3,415,644; 3,415,645; and 3,415,646.

The light-sensitive materials used for such instant colour image processes generally have the following structue:

Blue-sensitive silver halide emulsion layers;

Layer containing system which releases a yellow dye;

Separating layer;

Green-sensitized silver halide emulsion layer;

Layer containing system releasing a magenta dye;
Separating layer;
Red-sensitized silver halide emulsion layer;
Layer containing system releasing a cyan dye.

Furthermore, the emulsions according to the invention provide better stability, especially a better stability of the gradation curve of both black-and-white and of color materials, as compared with known emulsions, e.g. emulsions prepared in the presence of Rh-compounds. The desired gradation can be achieved with just one of the emulsions according to the invention or, as is generally known by mixing several of these emulsions, the gradation becoming flatter the more these emulsions differ in their sensitivity.

For example, the emulsions according to the invention may be used for a photographic recording material on a white, reflective supporting base for the production of positives. Such a material may contain three light-sensitive layers of which the red-sensitive layer, which contains the coupler capable of forming blue-green dye, is arranged farthest away from the supporting base. Beneath this layer are arranged and UV-absorbing intermediate layer, the green-sensitive layer containing the coupler for the formation of a purple dye and beneath this, separated by an intermediate layer the blue-sensitive layer containing the coupler for the yellow dye. Such materials may additionally contain compounds for stabilizing the white parts of the photographic images, e.g. n-octyl-hydroquinone, 2-ethyl-hexylhydroquinone and 2,5-bis-(1',1',3',3'-tetramethyl)-butylhydroquinone. These compounds may have been emulsified and can be applied in varying amounts, e.g. from 1 to 100 mg and particularly from 10 to 50 mg/m$^2$.

The materials prepared according to the invention may be developed with the usual colour developer compounds, e.g.

N,N-dimethyl-p-phenylenediamine;
4-amino-3-methyl-N-ethyl-N-methoxyethylaniline;
2-amino-5-diethylaminotoluene;
N-butyl-N-ω-sulphobutyl-p-phenylenediamine;
2-amino-5-(N-ethyl-N-β-methanesulphonamidoethylamino)-toluene;
N-ethyl-N-β-hydroxyethyl-p-phenylenediamine;
N,N-bis-(β-hydroxyethyl)-p-phenylenediamine and
2-amino-5-(N-ethyl-N-β-hydroxyethylamino)-toluene.

Other suitable colour developers have been described, for example, in J. Amer. Chem. Soc. 73, 3100 (1951).

The photographic material prepared according to this invention may contain the usual colour couplers which are generally incorporated in the silver halide layers. Thus, the red sensitive layer, for example, may contain a non-diffusible colour coupler for producing the cyan partial colour image, generally a phenol or α-naphthol coupler. The green sensitive layer may contain at least one non-diffusible colour coupler for producing the magenta particle colour image, usually a 5-pyrazolone or indazolone colour coupler. The blue sensitive layer unit may contain at least one non-diffusible colour coupler for producing the yellow partial colour image, generally a colour coupler which has an open chain ketomethylene group. Colour couplers of this type are known in large numbers and have been described in numerous Patent Specifications. References may be found, for example, in the publication "Farbkuppler" by W. Pelz in "Mitteilungen aus den Forschungslaboratorien der Agfa, Leverkusen/Munchen", Volume III (1961) and the publication by K. Venkataraman in "The Chemistry of Synthetic Dyes", Vol. 4, 341 to 387, Academic Press, 1971.

2-Equivalent couplers may also be used as non-diffusible colour couplers. These contain a releasable substituent in the coupling position so that they require only two equivalents of silver halide to produce the colour, in contrast to the usual 4-equivalent couplers. Suitable 2-equivalent couplers include, for example, the well known DIR couplers, in which the removable group is released as a diffusible development inhibitor after the reaction with colour developer oxidation products. So-called white couplers may also be used to improve the properties of the photographic material.

The non-diffusible colour couplers and colour producing compounds are added to the light-sensitive silver halide emulsions or other casting solutions by the usual methods. If they are water-soluble or alkali soluble compounds, they may be added to the emulsions in the form of aqueous solutions, optionally with the addition of water-miscible organic solvents such as ethanol, acetone or dimethylformamide. If the non-diffusible colour couplers and colour producing compounds used are insoluble in water or alkaline solutions, they may be emulsified in known manner, for example by mixing a solution of the compound in a low boiling organic solvent either directly with the silver halide emulsion or first with an aqueous gelatine solution and then removing the organic solvent in the usual manner. An emulsion of the given compound in gelatine obtained in this way is subsequently mixed with the silver halide emulsion. So-called coupler solvents or oil formers may also be used for emulsifying such hydrophobic compounds; these are generally organic compounds which have a relatively high boiling point and which enclose in the form of oily droplets the non-diffusible colour couplers and development inhibiting releasing compounds which are required to be emulsified in the silver halide emulsions.

Information may be found, for example, in U.S. Pat. Nos. 2,322,027; 2,533,514; 3,689,271; 3,764,336 and 3,765,897.

The binder used for the photographic layers is preferably gelatine although this may be partly or completely replaced by other natural or synthetic binders. Suitable natural binders include, for example, alginic acid and its derivatives such as its salts, esters or amides, cellulose derivatives such as carboxymethylcellulose, alkyl celluloses such as hydroxyethylcellulose, starch or its derivatives such as ethers or esters, or carragheenates. Suitable synthetic binders include polyvinyl alcohol, partially saponified polyvinyl acetate and polyvinylpyrrolidone.

The emulsions may also be chemically sensitized, e.g. by the addition of sulphur compounds at the chemical ripening stage, for example, allyl isothiocyanate, allyl thiourea and sodium thiosulphate. Reducing agents may also be used as chemical sensitizers, e.g. the tin compound described in Belgian Pat. Nos. 493, 464 and 568,687, or polyamines such as diethylene triamine or aminoethylsulphinic acid derivatives, e.g. according to Belgian Pat. No. 547,323.

Noble metals such as gold, platinum, palladium, iridium, ruthenium or rhodium and compounds of these metals are also suitable as chemical sensitizers. This method of chemical sensitization has been described in the article by R. Koslowsky, Z. Wiss. Phot. 46, 65–72 (1951).

The emulsions may also be sensitized with polyalkylene oxide derivatives, e.g. with a polyethylene oxide having a molecular weight of from 1000 to 20,000 or with condensation products of alkylene oxides and aliphatic alcohols, glycols, cyclic dehydration products of hexitols, alkyl substituted phenols, aliphatic carboxylic acids, aliphatic amines, aliphatic diamines and amides. The condensation products have a molecular weight of at least 700, preferably more than 1000. These sensitizers may, of course, be combined to produce special effects, as described in Belgian Pat. No. 537,278 and British Pat. No. 727,982.

The emulsions may also be optically sensitized, e.g. with the usual polymethine dyes such as neutrocyanines, basic or acid carbocyanines, rhodacyanines, hemicyanines, styryl dyes and oxonols. Sensitizers of this type have been described in the work by F. M Hamer entitled "The Cyanine Dyes and related Compounds", 1964, Interscience Publishers, John Wiley and Sons.

The emulsions may contain the usual stabilizers, e.g. salts or homopolar compounds of mercury containing aromatic or heterocyclic rings, such as mercaptotriazoles, simple mercury salts, sulphonium mercury double salts and other mercury compounds. Azaindenes are also suitable stabilizers, particularly tetra- and penta azaindenes and especially those which are substituted with hydroxyl or amino groups. Compounds of this type have been described in the article by Birr, Z. Wiss. Phot. 47 (1952), 2 to 58. Other suitable stabilizers include heterocyclic mercapto compounds such as phenyl mercaptotetrazole, quaternary benzothiazole derivatives and benzotriazole.

The emulsions may be hardened in the usual manner, for example with formaldehyde or halogen substituted aldehydes containing a carboxyl group, such as mucobromic acid, diketones, methanesulphonic acid esters and dialdehydes.

The photographic layers may also be hardened with epoxide type hardeners, heterocyclic ethylene imine hardeners or acryloyl hardeners. Examples of such hardeners have been described, for example, in German Offenlegungsschrift No. 2,263,602, and in British Pat. No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with hardeners of the diazine, triazine or 1,2-dihydroquinoline series as described in British Pat. Nos. 1,193,290; 1,251,091; 1,306,544 and 1,266,655; French Pat. No. 7,102,716 and British Pat. No. 1,452,669.

The following are examples of such hardeners: Diazine derivatives containing alkylsulphonyl or arylsulphonyl groups, derivatives of hydrogenated diazines or triazines, e.g. 1,3,5-hexahydrotriazine, fluorosubstituted diazine derivatives, e.g. fluoropyrimidine, esters of 2-substituted, 1,2-dihydroquinoline- or 1,2-dihydroisoquinoline-N-carboxylic acids. Vinyl sulphonic acid hardeners, carbodiimide hardeners and carbamoyl hardeners such as those described in German Offenlegungsschriften Nos. 2,263,602; 2,225,230 and 1,808,685, French Pat. No. 1,491,807, German Pat. No. 872,153 and DDR Pat. No. 7218 may also be used. Other suitable hardeners have been described, for example, in British Pat. No. 1,268,550.

EXAMPLE 1

The emulsions described in this Example are prepared as follows:

1. A solution of the following composition, hereinafter referred to as the "reaction medium", is introduced into the reaction vessel:

| Reaction medium | |
|---|---|
| Water | 1300 ml |
| Gelatine | 30 g |
| Potassium bromide | 0.16 g |

The reaction medium is adjusted to pH 6.0. The quantities of imidazole indicated in Table 2 are optionally added.

2. The following are then added separately by the double inflow method at 63° C.:

100 ml of a 0.3 molar silver nitrate solution and, at the same time, 100 ml of a 0.3 molar potassium bromide solution. The rate of inflow is the same for both solutions, and is initially 88 ml per hour for 4 minutes and is then increased by 22 ml per hour every 15 seconds until it reaches 660 ml per hour.

3. The following are then added separately by the double inflow method at a rate of 330 ml/h each:

85 ml of a 2-molar silver nitrate solution and, at the same time, 85 ml of a 2-molar potassium bromide solution.

4. The pAg is then adjusted to 9.6 with a 2-molar potassium bromide solution. At this pAg value, 400 ml of a 2-molar silver nitrate solution and the quantity of 2-molar potassium bromide solution required to keep the pAg constant are added by a pAg controlled process of double inflow, the rate of inflow of silver nitrate solution being 330 ml/h.

5. The resulting emulsions are then cooled, flocculated and washed in the usual manner and finally redispersed in a solution of 55 g of gelatine and 430 ml of water and, if desired, further processed as indicated.

Emulsions A to E indicated in Table 2 are obtained. In all of the emulsions according to the invention, the diameter of the octahedric silver halide grains is greater than that of the comparison emulsion without imidazole. The grain diameter increases with increasing quantity of imidazole without any other conditions of precipitation having to be altered. There is no need to subdivide the emulsion precipitate nor is any physical ripening to increase the grain size required.

TABLE 2

| Emulsion | Imidazole (g in reaction medium) | Crystal form | Crystal diameter (μm) |
|---|---|---|---|
| A (comparison) | 0 | octahedron | 0.50 |
| B | 0.9 | octahedron | 0.65 |
| C | 2.7 | octahedron | 0.90 |
| D | 9.0 | octahedron | 1.4 |
| E | 27.0 | octahedron | 2.0 |

The emulsion grains may be chemically ripened by known methods, as already mentioned above. As is will known, in the case of chemical ripening, the larger the emulsion grains, the shorter must be the ripening time or the lower the ripening temperature if usuable emulsions are to be obtained.

Comparison emulsion A and emulsions C and D are then further processed as follows:

1/10 of the resulting emulsion is adjusted to a pAg of 8.9 with a 1-molar potassium bromide solution at the ripening temperature indicated in Table 3, 3.5 mg of KSCN and 0.48 mg of $HAuCl_4$ are added and the reaction mixture is kept at the ripening temperature for two hours and then cooled. The indices 1, 2 and 3 are appended to emulsions A, B and C to indicate the temperatures at which the emulsions were ripened. To these ripened portions of the emulsions are then added 68 ml of a 0.001-molar methanolic solution of a spectral sensitizer corresponding to the following formula:

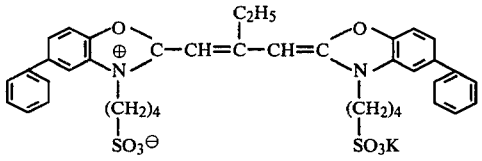

and the emulsions are cast on a substrate of cellulose acetate to form layer 0.18 mm in thickness. The amount of silver applied corresponds to 2.8 g/m². Strips of the resulting light-sensitive material are exposed behind a $3\sqrt[3]{2}$ wedge for 1/20 seconds. The exposed strips are then developed for 13 minutes at 20° C. in the following developer (developer 1):

| Developer 1 | |
|---|---|
| Water | 800 ml |
| p-methylammoniophenolsulphate | 3.5 g |
| Ascorbic acid | 9.0 g |
| Sodium carbonate, anhydrous | 14.0 g |
| Potassium bromide | 2.4 g |
| made up with water to | 1 liter. |

The layers are then fixed, washed and dried in the usual manner. The sensitivity is measured at a density of 0.1 above fog. As can be seen from Table 3, after chemical ripening, the sensitivity of emulsions C and D according to the invention is higher than that of comparison emulsion A.

TABLE 3

| Material containing emulsion | Ripening temperature | Image | Relative sensitivity |
|---|---|---|---|
| A 1 | 65° C. | Negative | 68 |
| A 2 | 67° C. | Negative | 71 |
| A 3 | 69° C. | Negative | 100 |
| C 1 | 65° C. | Negative | 166 |
| C 2 | 67° C. | Negative | 166 |
| C 3 | 69° C. | Negative | 170 |
| D 1 | 65° C. | Negative | 347 |
| D 2 | 67° C. | Negative | 389 |
| D 3 | 69° C. | Negative | 468 |

Doubling of the number in the column headed "relative sensitivity" corresponds to doubling of the sensitivity.

EXAMPLE 2

To precipitate the emulsion indicated in the following Table 4, the procedure is the same as indicated in Example 1 except that the quantities of the given imidazole derivative shown in Table 4 are added to the reaction medium. Emulsion A is a comparison emulsion for which no imidazole or imidazole derivative was added to the reaction medium for its preparation. Emulsions with octahedric emulsion grains are obtained in all cases.

TABLE 4

| Emulsion | Quantity of imidazole derivative (g in reaction medium) | Imidazole derivative | Diameter of octahedron (μm) |
|---|---|---|---|
| A | — | — | 0.5 |
| F | 10.9 | 1-methyl-imidazole | 1.5 |
| G | 10.9 | 2-methyl-imidazole | 1.2 |
| H | 12.7 | 1,2-dimethylimidazole | 0.9 |
| I | 14.3 | 1-allylimidazole | 2.0 |
| J | 14.8 | 1-methoxymethylimidazole | 1.4 |
| K | 18.5 | 1-(2-carboxyethyl)-imidazole | 0.9 |
| L | 10.8 | 4(5)-methyl-imidazole | 1.0 |
| M | 14.6 | 2-ethyl-4-methyl-imidazole | 0.9 |

As can be seen in Table 4, the use of the given imidazole derivatives has the same effect as the use of imidazole in resulting in silver halide crystals with a larger diameter.

EXAMPLE 3

Emulsion N indicated below is prepared as described in Example 1 but with the following changes:

1. The reaction medium contains in addition 9.0 g of imidazole.

2. The double inflow described under 4. in Example 1 is not carried out at a pAg of 9.6; the pAg is adjusted to 8.5 with a 2-molar potassium bromide solution. Silver halide cubes having a diameter of 1.7 μm (length of the side: 1,0 μm) are obtained.

Emulsion O (Comparison emulsion)

Emulsion O is prepared by the same methods as emulsion N except that the reaction medium contains no imidazole. Tetradecahedrons with a diameter of 0.50 μm are obtained.

Example 3 demonstrates that emulsions with cubical crystals can be prepared by means of the compounds used according to the invention.

EXAMPLE 4

Emulsion P indicated below is prepared by the same method as emulsion N except that the pH of the reaction medium is adjusted to 7.6. A heterodisperse emulsion with cubical crystals having a diameter of from 1.4 to 3.3 μm is obtained.

Emulsion Q (comparison emulsion)

Emulsion Q is prepared in the same way as Emulsion P except that the reaction medium contains no imidazole. Tetradecahedrons with a diameter of 0.55 μm are obtained.

This Example shows that heterodisperse emulsions can also be prepared with the aid of the compounds to be used according to the invention.

EXAMPLE 5

For the preparation of Emulsion R, the procedure is initially the same as that used for preparing Emulsion D. After the pAg controlled double inflow of 400 ml of a 2-molar silver nitrate solution and the corresponding quantity of a 2-molar potassium bromide solution carried out for the preparation of emulsion D, the resulting emulsion is heated to 70° C., 4.73 ml of a solution of 0.1 g of sodium dithiosulphato-aurate (I). $2H_2O$ in 100 ml of water are added, and the reaction mixture is kept at 70° C. for 45 minutes and then cooled to 63° C. Silver bromide is precipitated on the resulting chemically ripened emulsion grains by adding, by a process of pAg controlled double inflow at pAg 9.6, 1000 ml of a 2-molar silver nitrate solution and the quantity of 2-molar potassium bromide solution necessary to keep the pAg constant, the rate of inflow of the silver nitrate solution being 330 ml/h.

The emulsion is then cooled, flocculated and washed in the usual manner and redispersed in a solution of 195 g of gelatine in 1350 ml of water. The silver halide crystals of the emulsion form octahedrons with a diameter of 1.8 μm.

Portions of the emulsion prepared in this way, which contains internal nuclei, are then chemically ripened as follows:

1/10 of the emulsion precipitate is heated to 57° C. and adjusted to pAg 9.4 with a 1-molar potassium bromide solution, and 0.37 ml of a solution of 0.1 g of sodium dithiosulphato-aurate (I). $2H_2O$ in 100 ml of water is then added. The emulsions are maintained at 57° C. for 30 minutes (Emulsion R1), 45 minutes (Emulsion R2) or 60 minutes (Emulsion R3) and then cooled.

102 ml of a 0.001-molar methanolic solution of the spectral sensitizer indicated in Example 1 are added to the ripened portions of emulsion which are then cast on a 0.18 mm thick cellulose acetate substrate. The silver application is 3.3 g/m². Strips of the resulting light sensitive material are exposed behind a $3\sqrt[3]{2}$ wedge for 1/20 seconds. The exposed strips are developed in the following fogging developer (developer 2) for 10 minutes at 20° C.:

| Developer 2 | |
|---|---|
| Water | 800 ml |
| Sodium sulphite, anhydrous | 2.6 g |
| p-aminophenol | 3.3 g |
| Sodium hydroxide | 5.0 g |
| Trisodium phosphate . $12H_2O$ | 40.0 g |

The strips are then fixed, washed and dried in the usual manner. The sensitivity as defined in Example 1 is tested on emulsions R1, R2 and R3 at 0.9 times the maximum density. Table 5 shows that Emulsion R provides a light-sensitive photographic material which produces positive images.

The grain size and hence sensitivity can again be varied by varying the concentration of imidazole (or of its derivatives) but in the direct positive emulsions of Example 5 the internal and external ripening must be carefully adjusted to the grain size. It is therefore inadvisable to vary the grain size under constant conditions of ripening if usable direct positive emulsions are to be obtained every time.

TABLE 5

| Material containing emulsion | Time of external chemical ripening | Image | Relative sensitivity |
|---|---|---|---|
| A 3 | 120 mins. | Negative | 100 |
| R 1 | 30 mins. | Positive | 1500 |
| R 2 | 45 mins. | Positive | 790 |
| R 3 | 60 mins. | Positive | 600 |

The material containing Emulsion A 3 is similar to that described in Example 1.

EXAMPLE 6

The photographic material described below contains Emulsion S which is prepared as follows:

1. The reaction medium provided is a solution of:

| | |
|---|---|
| Water | 1300 ml |
| Gelatine | 30 g |
| Potassium chloride | 1 g |
| Imidazole | 9 g |

The solution is adjusted to pH 5.8.

2. The following are added separately by the method of double inflow to solution 1. above at 63° C.:

200 ml of 2-molar silver nitrate solution and at the same time 200 ml of 2-molar potassium chloride solution.

The rate of inflow is the same for both solutions. It starts at 110 ml/h for 4 minutes and is then raised by 22 ml/h every 15 seconds up to 220 ml/h.

3. The following solutions are then added separately by the double inflow method at a rate of 330 ml/h:

100 ml of 2-molar silver nitrate solution and, at the same time, 100 ml of 2-molar potassium bromide solution.

4. The pAg is then adjusted to 9.6 with a 2-molar potassium bromide solution. 700 ml of a 2-molar silver nitrate solution and the quantity of 2-molar potassium bromide solution necessary to maintain the pAg constant are added at this pAg by a method of pAg controlled double inflow, the silver nitrate solution being added at the rate of 440 ml/hour.

The emulsion is cooled, flocculated and washed in the usual manner and finally redispersed in a solution of 110 g of gelatine in 860 ml of water. The silver halide crystals of the emulsion are distorted octahedrons with a diameter of from 1.3 to 2.0 μm.

68 ml of a 0.001 molar methanolic solution of the spectral sensitizer indicated in Example 1 are added to 1/10 of the emulsion prepared as described above and the emulsion is then cast on a 0.18 mm thick cellulose acetate substrate. The silver application is 3.3 g.

Strips of the resulting light-sensitive material are exposed behind a $\sqrt[3]{2}$ wedge in a sensitometer for 1/20 seconds. The exposed strips are developed for 13 minutes at 20° C. in the developer described in Example 5. They are then fixed, washed and dried in the usual manner. The sensitivity of Emulsion S is measured at 0.9 times the maximum density. As can be seen from Table 5, the light-sensitive photographic material obtained with Emulsion S produces positive images.

The grain size and therefore the sensitivity can again be varied by varying the concentration of imidazole or of imidazole derivatives but in direct positive emulsions obtained according to Example 6 the ratio of $$\frac{\text{Volume of AgCl core}}{\text{Volume of AgBr shell}}$$

must be adjusted to the grain size. It is therefore inadvisable to vary the grain size at a constant percentage composition of the emulsion grains if usable direct positive emulsions are to be obtained each time.

TABLE 6

| Material containing emulsion | Image | Relative sensitivity |
|---|---|---|
| A 3 | Negative | 100 |
| S | Positive | 560 |

The material containing Emulsion A 3 is similar to that described in Example 1. The sensitivity is as defined in Example 1.

EXAMPLE 7

The following layers are applied one after the other to a transparent polyester foil used as substrate:

1. A mordanting layer of gelatine (6.0 g/m$^2$) and a polyurethane (6.0 g/m$^2$) of 4,4'-diphenylmethane diisocyanate, N-ethyl-diethanolamine and epichlorohydrin;
2. A reflection layer of titanium dioxide (24 g/m$^2$) and gelatine (2.4 g/m$^2$);
3. a layer of carbon black (1.9 g/m$^2$) and gelatine (2.0 g/m$^2$);
4. A dye layer containing 1.0 g/m$^2$ of the following compound:

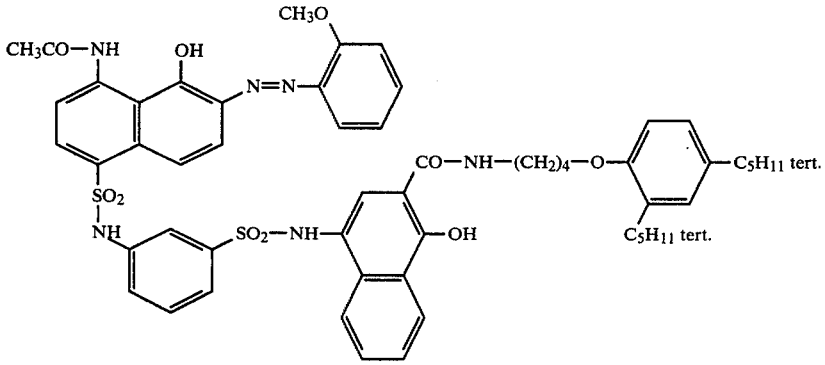

and gelatine (1.0 g/m$^2$);

5. an emulsion layer consisting of the spectrally sensitized emulsion S indicated in Example 6 (1.2 g of silver/m$^2$, 0.78 g of gelatine/m$^2$) and the fogging agent, acetic acid-2-phenyl hydrazide (1.35 mg/m$^2$);
6. a protective layer of gelatine (1 g/m$^2$) and formaldehyde (15 mg/m$^2$).

A strip of the light-sensitive material produced in this way is exposed in a sensitometer behind a $\sqrt[3]{2}$ wedge for 1/5 second. The exposed strip is then developed for 7 minutes with an alkaline developer paste of the following composition applied in a thickness of 0.180 mm:

| | |
|---|---|
| Water | 495 ml |
| Hydroxyethylcellulose | 15 g |
| Benzyl alcohol | 5 ml |
| Potassium hydroxide | 20 g |
| Ascorbic acid | 0.125 g |
| Methylbenzotriazole | 1.5 g |
| 1-phenyl-4-methyl-4-hydroxymethyl-3-pyrazolidone | 0.65 g |
| Hydroquinone | 0.05 g |
| Paraformaldehyde | 0.5 g. |

Placed along the longitudinal edges of the light-sensitive strips, are spacer strips which, together with the light-sensitive strips and a cover sheet, form a cavity which is filled with the developer paste. The paste is initially inside a rupturable container at one end of the cavity and is distributed in the cavity when the whole arrangement is passed between a pair of squeezing rollers. After development, the strip is stopped, washed and dried in the usual manner.

A magenta coloured positive image having a maximum colour density of 1.90 and minimum colour density of 0.23 is obtained.

What is claimed is:

1. Photographic material having at least one light-sensitive silver halide emulsion layer of silver halide grains, wherein the silver halide grains have been (a) precipitated at pH 5–6.5 in the presence of at least one water soluble imidazole in a sufficient amount of imidazole to produce increased grains of silver halide as light-sensitive crystals and corresponding to the following formula,

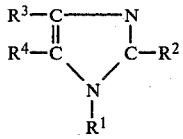

in which $R^1$, $R^2$, $R^3$ and $R^4$ which may be the same or different represent hydrogen or an alkyl, alkenyl, aryl or aralkyl group which may be substituted by hydroxyl, cyano, and alkoxy groups and free or esterified carboxyl and/or sulfoalkyl groups and (b) wherein the precipitated silver halide has been freed from water soluble salts and other water soluble substances.

2. Material according to claim 1, wherein the precipitated silver halide has been freed from water soluble salts and other water soluble substances by washing with water and/or by flocculation.

3. Material according to claim 1, characterized in that during precipitation of the silver halide crystals, the imidazole is present in the precipitating medium in a quantity of from $10^{-4}$ molar to the saturation limit.

4. Material according to claim 1, characterized in that the silver halide grains are precipitated in the presence of at least one of the compounds corresponding to the following formulae:

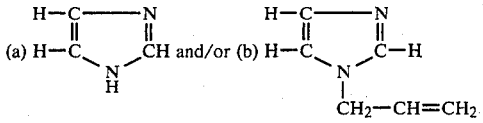

5. Material according to claim 1, characterized in that the silver halide emulsion has been obtained by blending at least two different silver halide emulsions.

6. Process for the preparation of photographic materials having at least one light-sensitive silver halide emulsion layer of silver halide grains, wherein the silver halide crystals have been precipitated at pH 5–6.5 in the presence of at least one water soluble imidazole in a sufficient amount of imidazole to produce increased grains of silver halide as light-sensitive crystals and corresponding to the following formula:

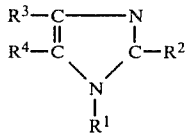

in which $R^1$, $R^2$, $R^3$ and $R^4$ which may be the same or different represent hydrogen or an alkyl, alkenyl, aryl or aralkyl group which may be substituted by hydroxyl, cyano, and alkoxy groups and free or esterified carboxyl and/or sulfoalkyl groups and wherein the precipitated silver halide has been freed from water soluble salts and other water soluble substances.

7. Process for the production of photographic images by imagewise exposure of a material according to claim 1 and development.

8. A process for the preparation of photographic materials having at least one light-sensitive silver halide emulsion layer of silver halide grains comprising the steps of first precipitating silver halide crystals from a reaction mixture in a first precipitate volume, and forming a limited number of silver nuclei in a first phase of crystal formation, at a pH of 5–6.5 in the presence of at least one water-soluble imidazole in a sufficient amount of imidazole to produce increased grains of silver halide as light-sensitive crystals and corresponding to the following formula:

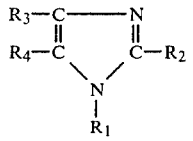

in which $R^1$, $R^2$, $R^3$ and $R^4$ which may be the same or different represent hydrogen or an alkyl, alkenyl, aryl or aralkyl group which may be substituted by hydroxyl, cyano and alkoxy groups and free or esterified carboxyl and/or sulfoalkyl groups and is free of a heteroaromatically bound nitrogen, and together with the imidazole nucleus could form a multiple ligand for silver ions, nor contains a thia group —S—;

immediately growing in a second phase of crystal formation silver halide crystals on said limited number of nuclei in the presence of said imidazole, wherein said imidazole inhibits the formation of additional silver nuclei.

and subsequently removing the imidazole from the second ripening volume so that to provide said silver halide emulsion free of a heteroaromatically bound nitrogen and then casting the imidazole-free emulsion on a support.

* * * * *